US005207209A

United States Patent [19]

Brockhaus

[11] Patent Number: 5,207,209

[45] Date of Patent: May 4, 1993

[54] ARRANGEMENT FOR IMPROVING STARTER BEHAVIOR

[75] Inventor: Herbert Brockhaus, Wettstetten, Fed. Rep. of Germany

[73] Assignee: Audi AG, Ingolstadt, Fed. Rep. of Germany

[21] Appl. No.: 838,742

[22] PCT Filed: Aug. 11, 1990

[86] PCT No.: PCT/EP90/01328

§ 371 Date: Mar. 12, 1992

§ 102(e) Date: Mar. 12, 1992

[87] PCT Pub. No.: WO91/05389

PCT Pub. Date: Apr. 18, 1991

[30] Foreign Application Priority Data

Sep. 29, 1989 [DE] Fed. Rep. of Germany ..... 3932564

[51] Int. Cl.[5] ..... F02P 15/12

[52] U.S. Cl. ..... 123/627; 123/179.5

[58] Field of Search ..... 123/627, 641, 179.5

[56] References Cited

U.S. PATENT DOCUMENTS

| | | | |
|---|---|---|---|
| 1,063,556 | 6/1913 | Kratz | 123/641 |
| 1,484,335 | 2/1924 | Kerrigan . | |
| 1,523,522 | 1/1925 | Graf . | |
| 2,684,451 | 7/1954 | Castongay . | |
| 3,244,924 | 4/1966 | Berg et al. . | |
| 4,046,127 | 9/1977 | Almquist et al. | 123/627 |

FOREIGN PATENT DOCUMENTS

| | | |
|---|---|---|
| 369673 | 2/1923 | Fed. Rep. of Germany . |
| 213997 | 7/1941 | Fed. Rep. of Germany . |
| 2056235 | 5/1972 | Fed. Rep. of Germany . |
| 2418261 | 10/1975 | Fed. Rep. of Germany . |
| 2357261 | 5/1978 | Fed. Rep. of Germany . |

*Primary Examiner*—Andrew M. Dolinar
*Attorney, Agent, or Firm*—Lalos & Keegan

[57] ABSTRACT

To improve the starting behavior of brand-new motor vehicles which, as export vehicles, have been stationary for considerable periods during a sea voyage it is proposed to insert a spark gap between the ignition coil and the distributor. When the spark jumps, a high voltage is suddenly delivered to the sparking plugs, thus preventing a shunt at that point.

4 Claims, 1 Drawing Sheet

ARRANGEMENT FOR IMPROVING STARTER BEHAVIOR

The invention relates to a motor vehicle with spark ignition internal combustion engine.

To start a motor vehicle with a spark ignition engine it is necessary to generate an ignition spark in the cylinder using a spark plug. However, in doing so, problems can arise.

In the delivery of exported new vehicles which have been transported by ship, it often occurs that there is a bypass on the spark plug which diverts the high voltage on the anode to ground before a high enough voltage can form to generate an ignition spark. It can be assumed that humidity and salty sea air contribute to this situation. It is a fact established by experience that when vehicles are driven off ships their starting behavior is clearly much worse than under other circumstances.

A generic motor vehicle is known from DE-C 369 673; in this document the activation of a series spark gap is proposed to improve starting behavior. The series spark gap is integrated into the spark plug and can be adjusted manually by the driver during the starting process or even while driving. To do this control cords are provided which run to the individual spark plugs and which when pulled swivel a lever which adjusts the length of the series spark gap, depending on how much it swivels. In addition, a thumb screw is assigned to the lever; the thumb screw makes it possible to fix the amount of swivel in order that the series spark gap be activated even while driving.

Thus it is proposed by this document that the driver can always activate the series spark gaps with maximum ease as soon as he needs them.

Ignition systems with series spark gaps are furthermore known from the state of the art; U.S. Pat. No. 1,484,335 proposes a spark gap which can be bridged with a bimetallic strip which short circuits the poles of the series spark gap when the engine is warm. U.S. Pat. No. 3,244,924 proposes a series spark gap between the coil and distributor which can be adjusted by remote control; CH-A-213997 describes a series spark gap which is directly assigned to the spark plug.

Additional state of the art can be taken from U.S. Pat. Nos. 1,523,522, 2,684,451 and U.S. Pat. No. 4,046,127.

For motor vehicle operation it is undesirable that the driver can activate the series spark gap at will; operation of a modern ignition system with series spark gap is problematical. However, it is desirable to propose a possibility for starting motor vehicles which can be activated only in the special case in which exported vehicles must be transported by sea and as a result start poorly.

SUMMARY OF THE INVENTION

The object of the invention is consequently to provide an improvement of the starting behavior by inserting a series spark gap which cannot be activated by the driver and which is not accessible when the vehicle is moving.

According to the invention the series spark gap known from the state of the art is implemented in a pushbutton switch which cannot be actuated by the driver himself, but a mechanic is needed to operate this switch. Thus, this series spark gap can only be activated for starting alone, since as soon as the vehicle is moving, the operator cannot operate the switch which is located preferably in the engine compartment. Hence, the series spark gap is shut down. Here there is a definite distance between the two electrodes of the spark gap, and adjustment is not possible since the size of the series spark gap is designed for this one time application.

when starting, the high voltage which builds upon the spark plug is brought to bear suddenly, i.e. a sparkover, by means of the spark gap and thus at the same time, due to the sudden application of the voltage. In this case the spark gap is adjusted such that the high voltage transferred to the spark plug in the sparkover is higher than the high voltage sufficient to generate an ignition spark. Under these conditions the spark plug is thus operated with a higher voltage than usual.

This spark gap is installed on the path between the ignition coil and distributor.

In normal operation this spark gap is short circuited. The hand actuated pushbutton switch however opens the bypass of the spark gap such that the increase of the voltage delivered by the ignition coil is transferred directly to the spark plug. Only when the voltage via the spark gap poles which are activated by opening the short circuit becomes so great that a spark flashes over is the high voltage suddenly applied to the spark plug.

If the exported vehicle cannot be started to drive it off the ship, a mechanic opens the hood and presses the pushbutton switch while the driver again operates the starter. In this way the disruptive effect of the bypasses on the spark plug is greatly reduced and the vehicle generally starts. At this point the mechanic can again release the switch and close the hood and the vehicle can be moved with the engine running. The heat generated in the engine compartment with the engine running dries up the moisture, and the vehicle subsequently again exhibits normal starting behavior.

The spark gap as per the invention can be built very cheaply with simple means.

Other objects and advantages of the present invention will become more apparent to those persons having ordinary skill in the art to which the present invention pertains from the following description taken in conjunction with the accompanying drawings.

DETAILED DESCRIPTION

Figure 1:
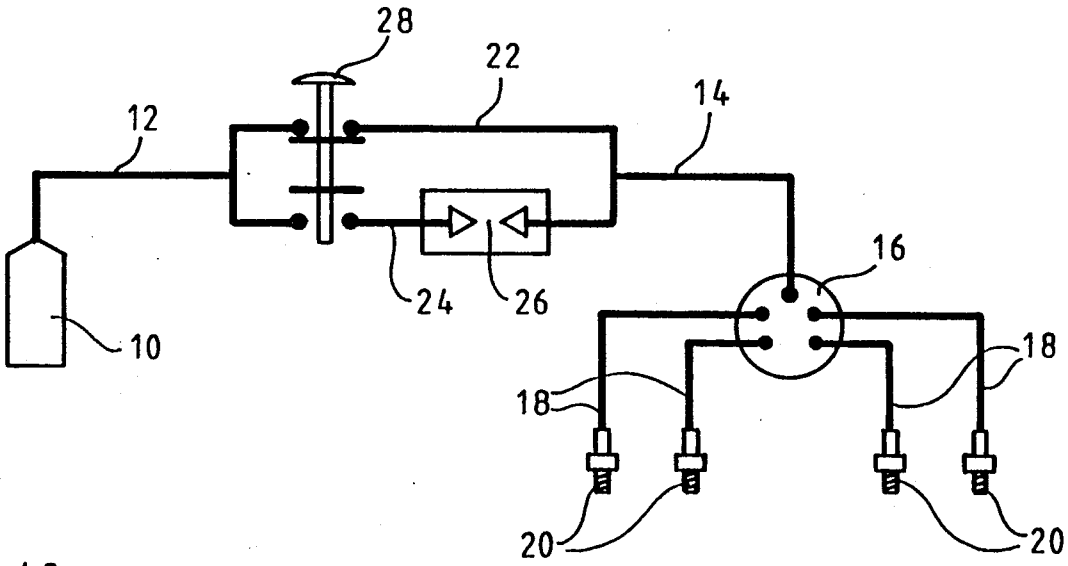
FIG. 1 shows a schematic diagram of the ignition structure with the spark gap as per the invention.

FIG. 1 shows the fundamental structure of the invention. An ignition coil 10 delivers high voltage via a high voltage cable 12 and 14 to a distributor 16. The distributor sends high voltage via lines 18 according to the ignition sequence to the spark plugs 20 where an ignition spark is generated using the high voltage.

Between lines 12 and 14 in the high voltage path are two paths 22 and 24 which are selectively triggered by a pushbutton switch 28. When the pushbutton switch 28 is not actuated there is a direct connection 22 between lines 12 and 14, with the switch 28 activated line 22 is interrupted and the branch 24 to connect high voltage line 12 to high voltage line 14 is turned on. In the branch 24 is a spark gap 26 in which a certain voltage, depending on the distance of the two poles in the spark gap, results in a spark flash over, whereupon a high voltage is delivered from the coil 10 to the distributor 16 and thus to the spark plugs 20.

Figure 2:
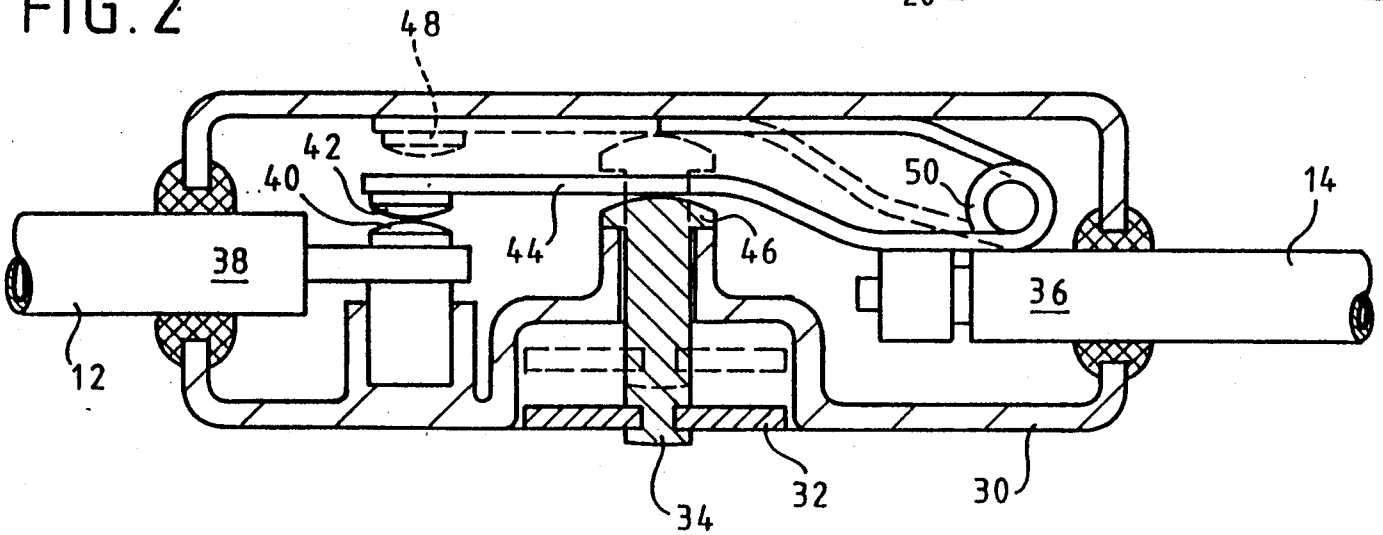
FIG. 2 shows one version of the pushbutton switch for use in the arrangement as per the invention.

FIG. 2 shows a specific version for use in a motor vehicle A housing 30 surrounds the circuit Electrical lines which can be connected to the ignition coil or distributor are routed to the housing 30 with terminals 12 and 14. On the outside of the housing 30 is a pushbutton 32; depressing it moves a plunger 34. The end 46 of the plunger 34 lies on a metal reed 44 which bears an electrical contact 42 on its front end. The reed 44 is electrically connected to the line 14 at point 36.

The contact 42 lies on a mating contact 40 when the button 32 is not actuated. The mating contact 40 is electrically connected in 38 to line 12.

Thus, there is an electrical connection from the line 12 via the terminal 38 and contact pair 40 and 42 to the reed 44, the connection 36 and further via the line 14.

If at this point the button 32 is depressed, the contact 42 is lifted off the contact 40 and moves into the position 48 shown by the broken line. A spring 50 tries to press the reed 44 back into a position which corresponds to an arrangement of contacts 40 and 42.

By means of the space between contact 40 and contact 42 in its position 48 a spark gap is generated as long as the button 32 is depressed.

If at this point the button 32 of the pushbutton switch installed between the ignition coil and distributor is depressed by a mechanic when the vehicle is started, a voltage builds up between the contact 40 and contact 42 in its position 48; this voltage flashes over as a spark only at high ignition voltage and is thus transferred to the spark plug.

The voltage is defined by the contact spacing which can be preselected using the plunger stroke. As an additional measure the housing 30 can be filled with a protective gas; in this way different operating conditions and flashover voltages, for example, due to atmospheric humidity, can be avoided. This protective gas would also be advantageous for contact erosion, for which however it can be assumed that the pushbutton switch as per the invention is used essentially in the first startup of a brand new vehicle which however has not be operated for a longer period of time when shipped by sea.

I claim:

1. A motor vehicle comprising:

a spark ignition internal combustion engine having a plurality of cylinders, an ignition coil, and at least one spark plug for each of said cylinders, a means for improving the starting behavior of said engine comprising a spark gap located between said ignition coil and said spark plug, a first electrical terminal connected to said ignition coil, a second electrical terminal connected to said spark plug, a housing surrounding said spark gap and having a first contact connected to said first electrical terminal and a second contact selectively spaced from said first contact to form said spark gap and connected to said second electrical terminal, said housing having a pushbutton switch including a plunger contacting said second contact, said pushbutton switch being actuatable from outside said housing between an open and closed position, said pushbutton switch bridging said spark gap when in said closed position, said pushbutton switch moving said second contact away from said first contact along a predetermined path to achieve a predetermined contact spacing when in said open position.

2. The motor vehicle according to claim 1, wherein said motor vehicle is driven by an operator, said pushbutton switch being actuated by a mechanic only when said motor vehicle is being started.

3. A motor vehicle according to claim 1, wherein said internal combustion engine further includes a distributor, said spark gap being located between said ignition coil and said distributor.

4. A motor vehicle according to claim 2, further comprising a protective gap surrounded by said housing.

* * * * *